US006314622B1

(12) United States Patent
Takizawa et al.

(10) Patent No.: US 6,314,622 B1
(45) Date of Patent: Nov. 13, 2001

(54) ENGAGING MEMBER OF FASTENING DEVICE

(75) Inventors: Toshiaki Takizawa; Yoshinobu Takahashi, both of Toyama-ken (JP); Angelo Piacenza, Milan (IT)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/450,391

(22) Filed: Nov. 29, 1999

(30) Foreign Application Priority Data

Dec. 24, 1998 (JP) ..... 10-366749

(51) Int. Cl.[7] ..... A44B 18/00
(52) U.S. Cl. ..... 24/306; 24/114.9; 24/444
(58) Field of Search ..... 24/306, 114.9, 24/444

(56) References Cited

U.S. PATENT DOCUMENTS

| | | | | |
|---|---|---|---|---|
| 4,592,118 | * | 6/1986 | DeWoskin | 24/306 |
| 4,596,540 | * | 6/1986 | F'Geppert | 24/306 |
| 4,939,794 | | 7/1990 | Aronson . | |
| 5,048,160 | | 9/1991 | Goodrich et al. . | |
| 5,379,491 | * | 1/1995 | Solo | 24/306 |
| 5,422,156 | * | 6/1995 | Billarant | 24/306 |
| 5,548,878 | * | 8/1996 | Romagnoli | 24/306 |

FOREIGN PATENT DOCUMENTS 0 763 335 3/1997 (EP) .

* cited by examiner

*Primary Examiner*—Victor N. Sakran
(74) *Attorney, Agent, or Firm*—Finnegan, Henderson, Farabow, Garrett & Dunner, L.L.P.

(57) ABSTRACT

This invention provides an engaging member of a fastening device integrally molded of synthetic resin which enables sewing thereof to clothes easily and accurately, ensures ease and smoothness in an operation for opening the engaging member of the fastening device even if it is molded relatively thick, and prevents too much force being applied to a sewing yarn by an external force upon the opening operation thereby ensuring durability and contributes to reduction of production cost. The engaging member of the fastening device is integrally molded with a substantially J-shaped section, consisting first and second flat plate portions substantially parallel with different lengths and made of thermoplastic synthetic resin material, whose each of end portions is connected via a connecting portion, wherein a number of engaging elements are formed on the surface of the first flat plate portion having a larger area such that they are in an upright position and a groove-like sewing line is formed along an entire peripheral edge portion thereof, a groove-like sewing line whose end portions are open is formed corresponding to part of the sewing line formed on the first flat plate portion on the second flat plate portion having a smaller area, and a tab made of the same resin material is molded integrally on the connecting portion so as to project outward from the connecting portion in parallel to the flat plate portions.

3 Claims, 6 Drawing Sheets

ENGAGING MEMBER OF FASTENING DEVICE

BACKGROUND OF THE INVENTION

1. Field of the Invention

The present invention relates to an engaging member of a fastening device made of synthetic resin which substitutes for a conventional snap button and ordinary button.

2. Description of the Related Art

A conventional engaging member of a fastening device of this kind made of synthetic resin has been disclosed in, for example, Japanese Patent Application Laid-Open No.9-75113. This Laid-Open invention was proposed by the same inventor of the present invention and as for an outline structure of that invention, each ends of two flat plate portions substantially parallel to each other and made of thermoplastic synthetic resin having the same shape are connected integrally with a connecting portion in a substantially U-shaped section. A number of engaging elements are formed in an upright position on the surface of one of the flat plate portions connected with the connecting portion. Additionally, a tab is integrally molded of the same resin material on the connecting portion so as to project outward in parallel to the flat plate portions from the connecting portion. Further, groove-like sewing lines are formed on the surface of each of the flat plate portions along an entire peripheral edge thereof.

Because this engaging member of the fastening device is an integrally molded product of thermoplastic synthetic resin, not only its configuration is stable. but also a fashionable product having a desired configuration and pattern can be produced through a single molding process at a low cost. Particularly because this engaging member of the fastening device is molded in a condition in which first and second flat plate portions are maintained in parallel and connected with the connecting portion, the engaging member of the fastening device can be attached to clothes neatly, and positioning of the engaging member of the fastening device is easy. Further, because the tab is integrally molded on the engaging member of the fastening device to project outward from the connecting portion, an operation for opening and closing the engaging member of the fastening device is also easy.

However, although of each of the flat plate portions needs to be molded as thin as possible to ensure flexibility of the clothes on which this engaging member of the fastening device is attached, a thinner sewing line is formed along an entire peripheral edge thereof as described above, and therefore, the engaging member of the fastening device is likely to be broken at that portion, which means there is a limit in reducing the thickness of the flat plate portion. Further, as the thickness thereof decreases, it is more difficult to make outlines of the respective flat plate portions correspond to each other when the two flat plate portions are set up on an edge of clothes, so that the aforementioned sewing lines formed on both the flat plate portions often displace from each other. Therefore, it is difficult to sew the engaging member of the fastening device accurately along the same sewing line.

Even if the thickness of each flat plate portion is minimized to cope with such a disadvantage, when the engaging member of the fastening device is attached to an edge of clothes, it comes that an edge of the clothes is nipped by two flat plate portions at the mounting portion, so that the portion feels extremely stiff. Although there is no problem in closing the engaging member of the fastening device because it only has to be pressed, particularly upon opening it, unless the opening operation is carried out with a mating female fastening device member being pressed until the opening is finished, the whole engaged portion moves so that it is impossible to make a smooth opening operation. Therefore, upon attaching/detaching the surface engaging member of the fastening device, particularly upon detaching it, it is difficult to detach the entire engaging member of the fastening device all at once, but instead it must be detached with one fastening device member being rolled up, which is a typical attaching/detaching operation for a surface fastener.

Further, because the flat plate portion facing the surface of the clothes is sewed along an entire peripheral edge thereof, at the time of the opening operation described above, a shearing force is applied to a sewing yarn sewn perpendicular to the direction of the opening operation, so that the sewing yarn may sometimes be torn by repeated opening operations.

What is most difficult to handle of this engaging member of the fastening device is that because the two flat plate portions are of the same shape in a plan view, when this is attached to an edge of the mounting portion of the clothes, the two flat plate portions must be turned outward with respect to the connecting portion so as to open the end portion thereof and then an edge of the mounting portion of the clothes is inserted into this opening. Such a troublesome procedure is needed to attach the engaging member of the fastening device to the clothes.

SUMMARY OF THE INVENTION

The present invention has been accomplished to solve these problems with some improvements added to the above mentioned engaging member of fastening device, and it is an object of the invention to provide an engaging member of a fastening device integrally molded of synthetic resin which enables sewing thereof to clothes easily and accurately, ensures ease and smoothness in an opening operation of the engaging member of the fastening device even if it is molded relatively thick, and prevents too much force being applied to a sewing yarn by an external force upon the opening operation, thereby ensuring durability and contributes to reduction of production cost.

The object is achieved effectively as described below.

According to a first aspect of the invention, there is provided an engaging member of a fastening device which is integrally molded with a substantially J-shaped section, comprising first and second flat plate portions substantially parallel to each other and made of thermoplastic synthetic resin material, whose one end portions are connected via a connecting portion, wherein a number of engaging elements are formed on the surface of the first flat plate portion having a larger area such that they are in an upright position, and a groove-like sewing line is formed along an entire peripheral edge portion thereof, a groove-like sewing line whose end portions are open is formed corresponding to part of the sewing line formed on the first flat plate portion on the second flat plate portion having a smaller area, and a tab made of the same resin material is molded on the connecting portion so as to project outward from the connecting portion in parallel to the flat plate portions.

On contrary to the engaging member of the fastening device disclosed in the aforementioned patent application, since the engaging member of the fastening device of the present invention has one of two flat plate portions connected via the connecting portion formed shorter, upon attaching it, an edge of the clothes can be inserted between the two flat plate portions easily without opening the two flat plate portions. Further, although the groove-like sewing line is formed along an entire peripheral edge of the first flat plate portion having a larger surface area, the second flat plate portion having a smaller surface area has only a groove-like sewing line, in a U-shape whose end is open at an edge opposite to the connecting portion, formed at a portion overlapping the sewing line formed on the first flat plate portion. Thus, a displacement between the sewing lines of the first and second flat plate portions diminishes so that not only sewing is achieved securely along the sewing line, but also, because the surface of the clothes is directly sewed subsequent to sewing of the second flat plate portion, upon opening/closing the engaging member of the fastening device, particularly upon opening operation, no extra force in the shearing direction is applied to the sewing yarn by the second flat plate portion on contrary to the engaging member of the fastening device disclosed in the aforementioned patent application, so that the sewing yarn is never torn.

Further, according to the present invention, because the first flat plate portion having a larger surface area is disposed on a rear surface of an engaging member of the fastening device mounting portion of the clothes, and the second flat plate portion having a smaller surface area is disposed on the front surface of the clothes, a feeling of stiffness of the attaching portion is eliminated on appearance and in substance, providing better looks. Further, even if the thickness of the flat plate portion is increased to some extent, a required flexibility is ensured, thereby the opening operation of the engaging member of the fastening device being carried out smoothly.

Preferably, there is provided an engaging member of fastening device, in which a number of the engaging elements are integrally molded on the surface of the first flat plate portion. Further preferably, there is provided an engaging member of fastening device in which a number of the engaging elements are formed integrally on the front surface of a base cloth by knitting and weaving, and a rear surface of the base cloth is fixed to the surface of the first flat plate portions by bonding or the like. In case where the engaging elements are integrally molded with the flat plate portion as mentioned above, productivity is increased thereby leading to reduction of production cost.

DESCRIPTION OF THE PREFERRED EMBODIMENTS

Figure 1:
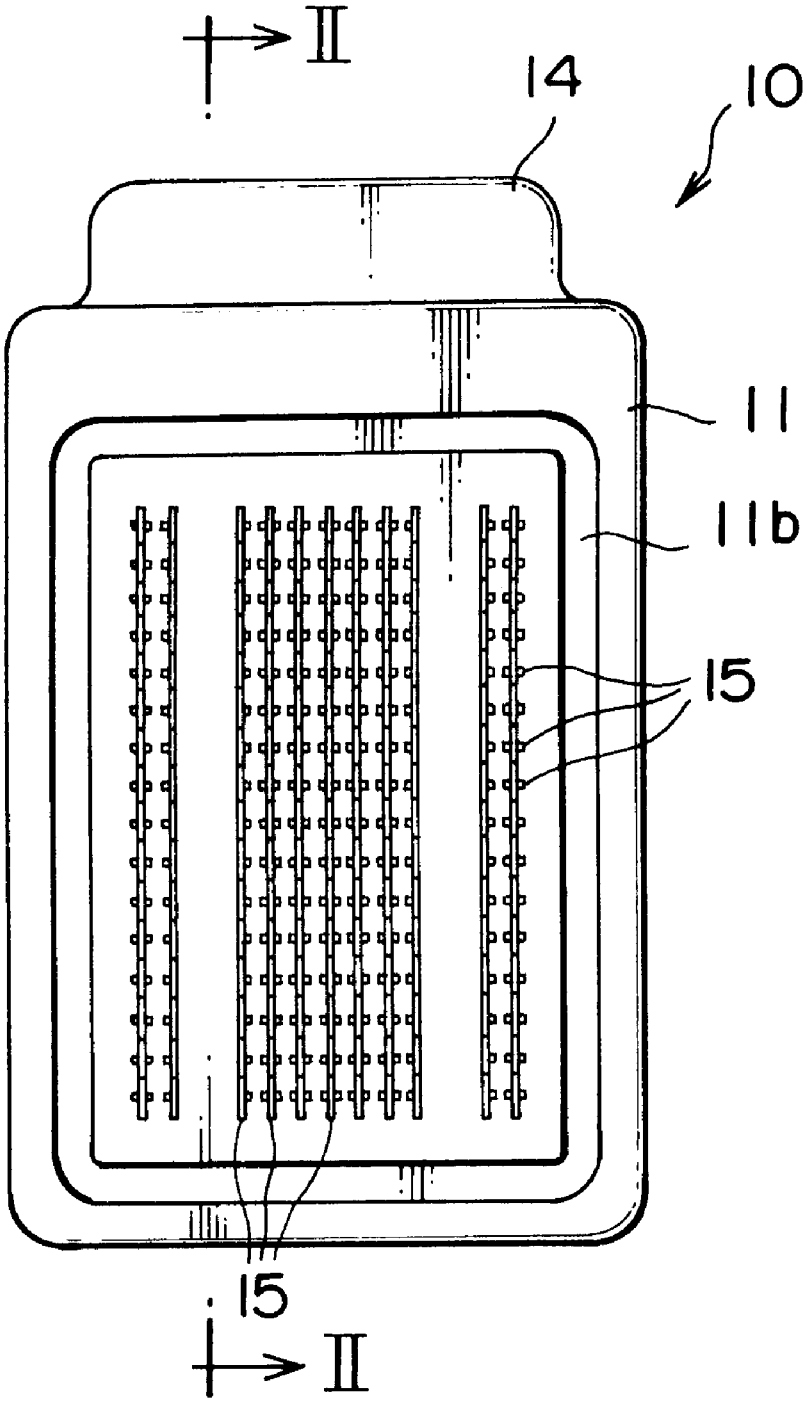
FIG. 1 is a front view showing a typical embodiment of an engaging member of a fastening device according to the present invention.
Figure 4:
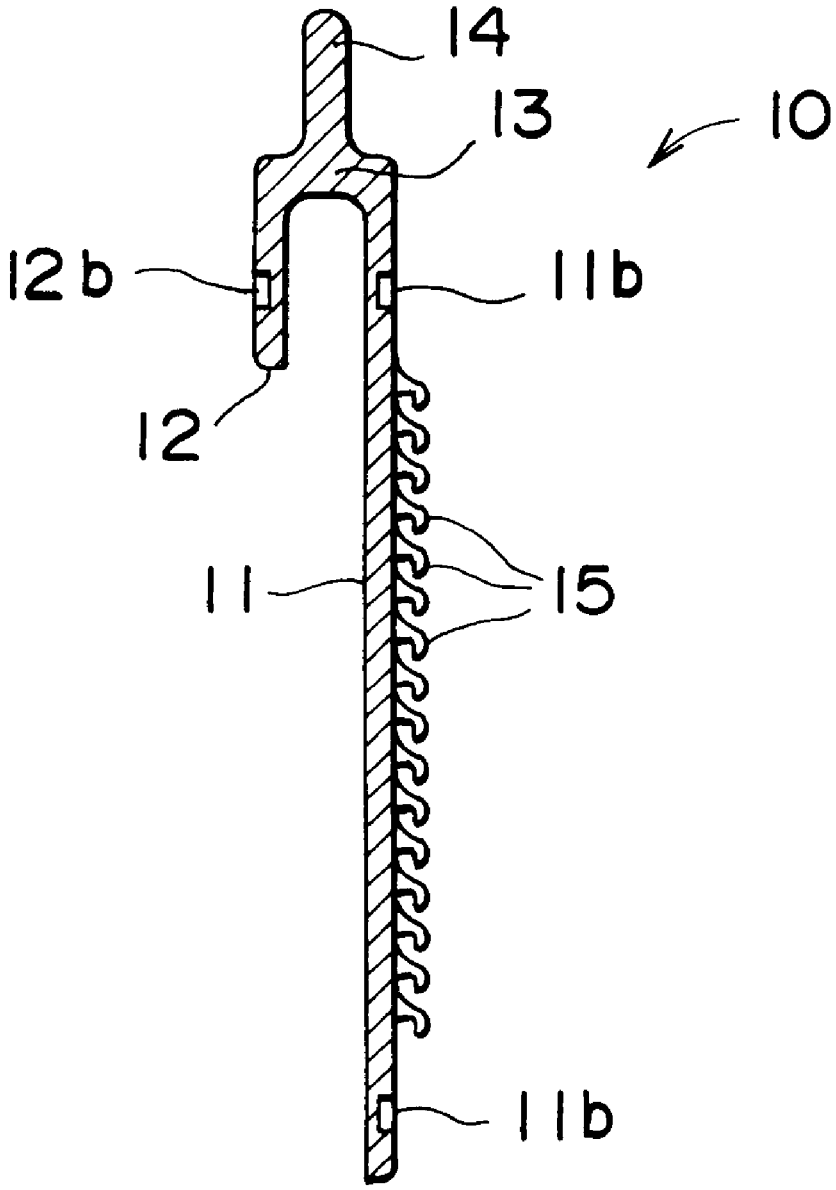
FIG. 4 is a sectional view taken along the line II—II of FIG. 1.
Figure 5:
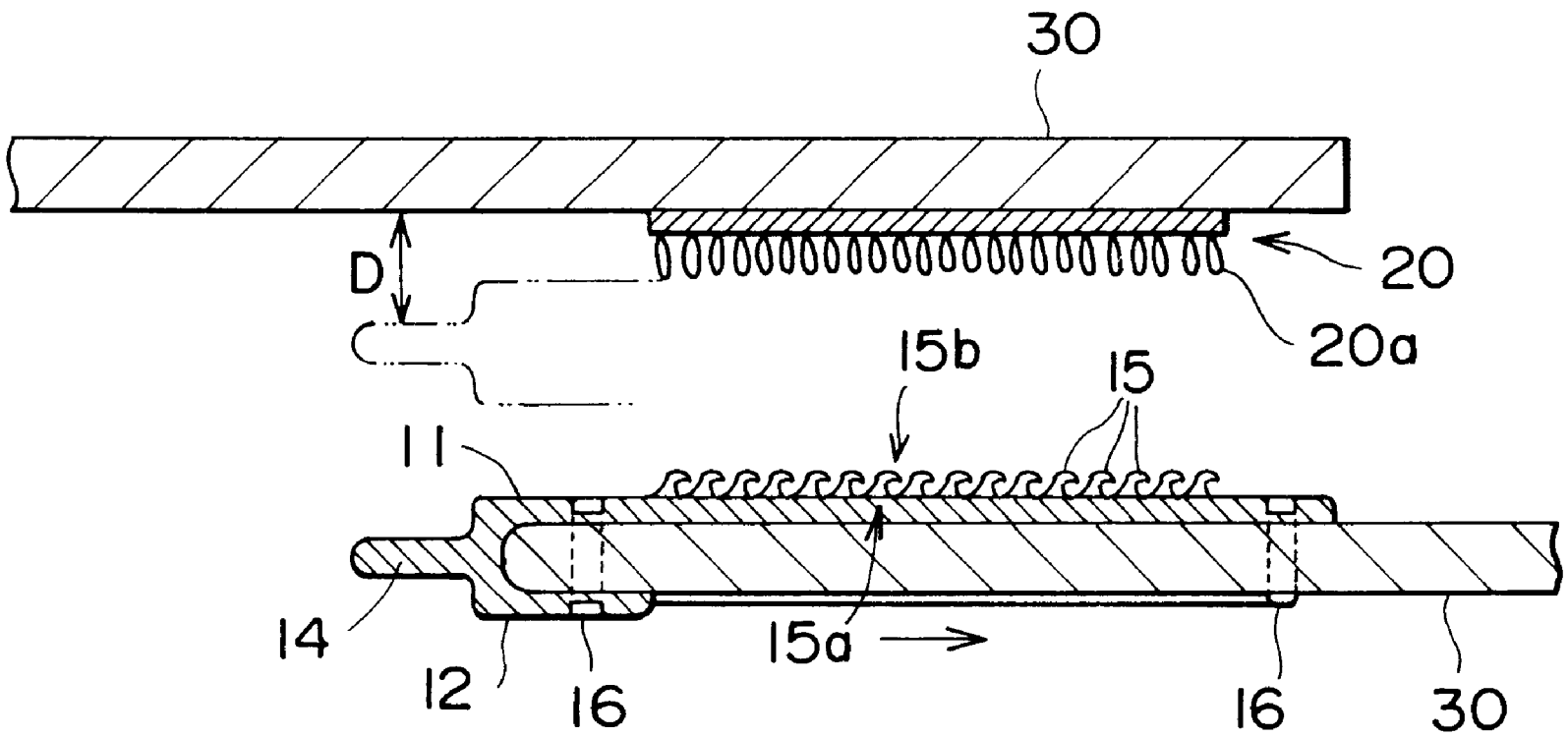
FIG. 5 is a sectional view of principal portions upon attaching the engaging member of the fastening device.

Hereinafter, the preferred embodiments of the present invention will be described specifically with reference to the accompanying drawings. FIG. 1 is a front view of an engaging member of a fastening device according to this embodiment, FIG. 2 is a rear view thereof, FIG. 3 is a side view thereof, FIG. 4 is a sectional view taken along the line II—II of FIG. 1 and FIG. 5 is a sectional view showing an example of use style of the engaging member of the fastening device.

An engaging member of a fastening device 10 according to this embodiment comprises a first flat plate portion 11 having a substantially rectangular shape, a second flat plate portion 12 of a rectangular shape having a long side having the same length as a short side of the first flat plate portion 11 and a short side substantially ⅓ of the length of the long side of the first flat plate portion 11 and a connecting portion 13 for connecting a short side edge of the first flat plate portion 11 with a long side edge of the second flat plate portion in a parallel manner and with a predetermined gap, and a side view of an entire shape thereof is substantially J shaped.

According to this embodiment, a tab 14 is provided on the connecting portion 13 such that it projects outward in parallel to the first and second flat plate portions 11 and 12. The aforementioned gap between the first and second flat plate portions 11 and 12 is determined arbitrarily depending on the thickness of a mounting portion of clothes on which the engaging member of the fastening device 10 of the present invention is to be mounted.

Figure 2:
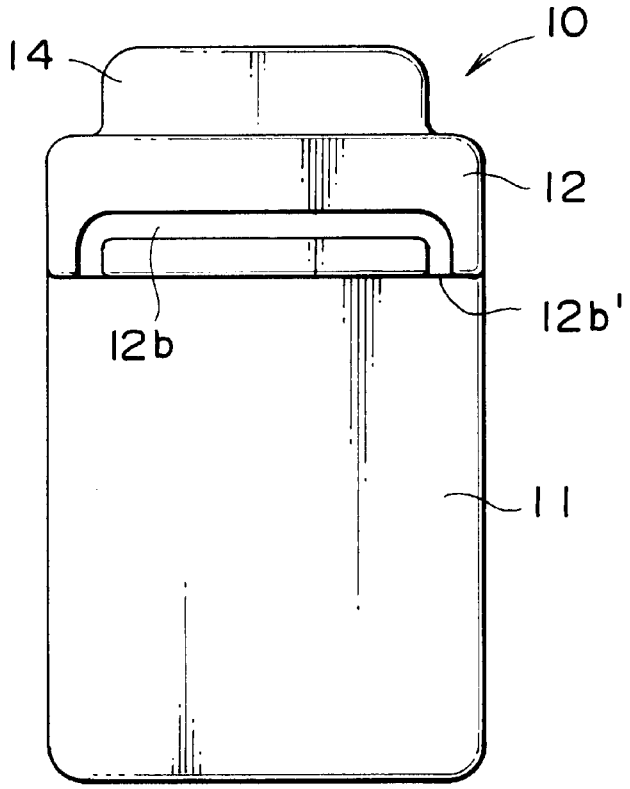
FIG. 2 is a rear view of the same.
Figure 3:
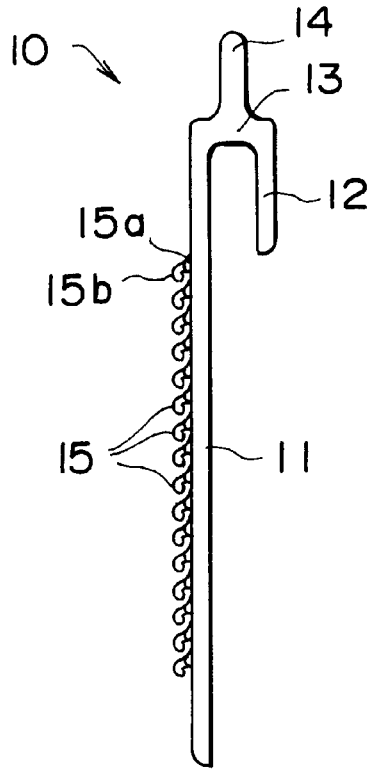
FIG. 3 is a side view of the same.

As shown in FIGS. 2 and 3, a number of engaging elements 15 are formed so as to project in plural rows on the surface (rear surface of the engaging member of the fastening device 10) of the first flat plate portion 11. The engaging element 15 of this embodiment is in a hook shape having a standing portion 15*a* standing up from the second flat plate portion 12 as shown in FIG. 3 and an engaging portion 15*b* extending outward in a curved shape from a front end of the standing portion 15*a*. In the example shown in the drawing, all of the engaging portions 15*b* extend in the same direction. Further, because the respective hook-shaped engaging elements 15 are formed such that front ends of the engaging portions 15*b* are directed in an opposite direction to the projecting direction of the tab 14, an engaging strength thereof with a mating fastening device member 20 having a number of loop pieces 20*a* as shown in FIG. 5 is strongest in a single direction which is opposite to the extending direction of the curved engaging portion 15*b*. In addition, a continuous groove portion 11*b* serving as a sewing portion is formed along an entire peripheral edge of the surface of the first flat plate portion 11. Although this groove portion 11*b* is not necessary if a thickness of the first flat plate portion 11 does not affect sewing operation, it is preferable to form the groove portion 11*b* even if it is a very small one, so that a sewing line can be recognized.

Various kinds of decorative patterns may be formed on the surface of the second flat plate portion 12 although not shown in the Drawings. Preferably, this pattern should be formed at the same time when this plate portion is molded, but it can be formed with various welders or prints after the plate portion is molded. A groove portion 12*b* is formed on the surface of the second flat plate portion 12 in a U-shape along a sewing line corresponding to part of the aforementioned groove portion 11*b* formed on the surface of the first flat plate portion 11. That is, as shown in the drawing, the groove portion 12*b* is formed continuously along the edge connected by the connecting portion 13 of the second flat plate portion 12 and both right and left edges across said edge, and a distal end thereof extends up to an edge opposite to the connecting portion 13 of the second flat plate portion 12, serving as an open edge 12*b*′.

The engaging member of the fastening device 10 of this embodiment having such a structure can be molded simply in a single process of, for example, injection molding. That is, a movable die (not shown) has a cavity for molding the first flat plate portion 11, a number of the engaging elements 15 and a part of the connecting portion 13, and on the other hand, a fixed die has a cavity for molding an external shape of the second flat plate portion 12, decorative pattern and a part of the connecting portion 13. Additionally, a plate-like insert die having a predetermined thickness is placed between the fixed die and movable die. With injection molding die having these dies, the engaging member of the fastening device can be easily molded.

Since a cavity for the hook-shaped engaging element 15 cannot be cut into a single die surface because of its configuration, all or partial shape of the cavity is formed in an end face of plural thin sheet materials and by overlaying these sheet materials in an appropriate combination, the cavity for the hook-shaped engaging element 15 is formed. Although a molded product may be pulled out directly from the aforementioned hook-shaped cavity with such a release member as an ejector pin (not shown), it may be separated easily by separating the aforementioned plural thin sheet materials in direction of sheet thickness with appropriate means.

Figure 6:
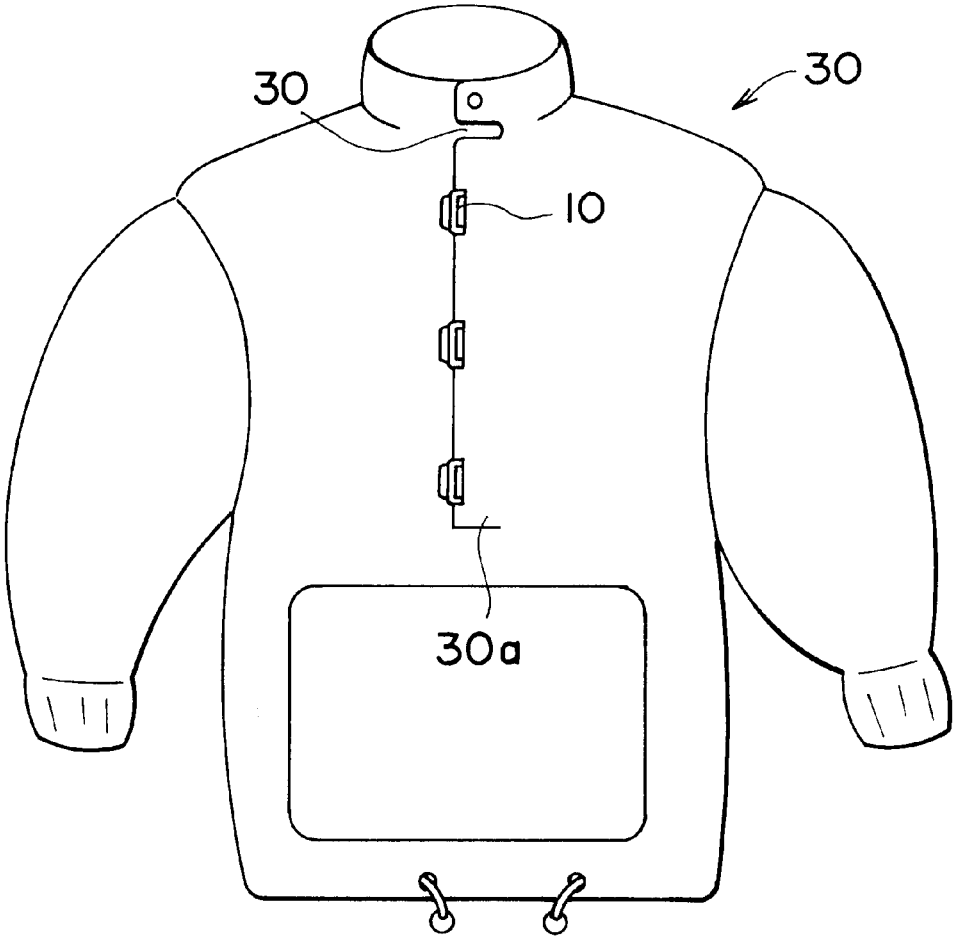
FIG. 6 is a front view showing an example of clothes having the engaging member of the fastening device of the present invention.

To attach the engaging member of the fastening device 10 of this embodiment having such a structure to clothes or the like, with the tab 14 outside as shown in FIG. 5 and a face of which each of the engaging elements 15 project facing inner side of the clothes, for example, an outer skirt edge 30*a* of a fly portion of a ski wear 30 shown in FIG. 6 is sandwiched by the first and second flat plate portions 11 and 12, the engaging member of the fastening device 10 is set up at a predetermined position and sewed along the groove portion 11*b* with sewing yarn 16. The engaging member of the fastening device 10 may be adhered with adhesive instead of sewing. In case of attaching by adhering, the groove portion 11*b* is also preferred to be formed for the reason described later. On the other hand, a mating fastening device member 20 having a number of loop pieces 20*a* which engages with/disengages from the engaging member of the fastening device 10 is attached on an inner skirt edge 30*b* of the aforementioned fly portion by sewing or bonding corresponding to the mounting position of the engaging member of the fastening device 10 as shown in FIG. 5.

When the upper skirt edge 30*a* of clothes is inserted into a gap between the first and second flat plate portions 11 and 12 of the engaging member of the fastening device 10 of this embodiment, contrary to the engaging member of the fastening device described under the aforementioned Patent Number, because of substantially J-shaped cross section, the upper skirt edge 30*a* of clothes can be inserted easily without opening an opening end thereof. Further, because the mounting posture of the engaging member of the fastening device 10 is automatically determined by bringing an insertion end thereof into contact with an inner wall of the connecting portion 13, the engaging member of the fastening device 10 can be attached neatly. Further, because the engaging member of the fastening device 10 is fixed such that at least the edge of the clothes of the mounting portion is nipped by the first and second flat plate portions 11 and 12 and connecting portion 13, separation never occurs between the clothes edge and each edge of the engaging member of the fastening device 10, and further, because the tab 14 extending outward from the connecting portion 13 is provided, durability and operability for opening/closing are secured.

Because the extending length of the second flat plate portion 12 from the connecting portion 13 is by far shorter than the extending length of the first flat plate portion 11, a displacement is not likely to occur between the edges of the first flat plate portion 11 and second flat plate portion 12, and therefore, a displacement of the groove portions 11*b* and 12*b* for forming the sewing lines on the surfaces of the respective flat plate portions 11 and 12 can be minimized. Thus, only if sewing is carried out along the groove portion 11*b* of the first flat plate portion 11 as described above, the engaging member of the fastening device 10 is automatically sewed along the groove portion 12*b* of the second flat plate portion 12 existing on a rear surface across a clothes, ensuring a beautiful finish.

Further, the groove portion 12*b* for determining the sewing line formed on the second flat plate portion 12 is formed in a U-shape corresponding to the sewing line corresponding to part of the groove portion 11*b* formed on the surface of the first flat plate portion 11 as described above, and a distal end of the groove portion 12*b* is open. Therefore, a sewing yarn to be sewn along the groove portion 11*b* left in the first flat plate portion 11 is sewed directly on clothes or the like on the side of the second flat plate portion 12.

According to the prior art, when the engaging member of the fastening device 10 is separated from the loop pieces 20*a* of the female engaging member of the fastening device member 20 to open the engaging member of the fastening device 10, too much force is applied in a shearing direction on sewing yarn portion which is to be fixed perpendicular to an opening direction of a portion opposite, in particular, to the connecting portion of the second flat plate portion which is fixed by the sewing yarn along the entire peripheral edge. However, with the aforementioned structure, because the sewing yarn sewed perpendicular to the separation direction is sewed directly to clothes and the second flat plate portion 12 which should be fixed by the sewing yarn does not exist, no such extra force is applied so that the clothes or sewing yarn is unlikely to be torn.

FIG. 6 shows an appearance of a ski wear to which the engaging member of the fastening device 10 of the present embodiment and a mating fastening device member (not shown) are attached. When the engaging member of the fastening device 10 is pressed against the mating fastening device member 20 attached to a position corresponding to the first flat plate portion 11 of the engaging member of the fastening device 10 of the present invention, both engage each other easily so that the fly portion shown in the drawing is closed. Because the engaging portions 15*b* of all the hook-shaped engaging elements 15 are directed toward an opening direction of the fly portion according to this embodiment, even if a strong external force is applied in a sliding direction so as to open the fly portion, the loop pieces 20*a* act in a shearing direction of the standing portion 15*a* of the hook-shaped engaging elements 15, that is, a direction of a maximum engaging strength, so that the engaging member of the fastening device 10 will not easily disengage.

In the closed condition, as shown by a fading line of FIG. 5, there is a gap D between the tab 14 of the engaging member of the fastening device 10 and an inner half portion of the fly portion, and therefore it is easy to insert a finger into this gap D thereby facilitating a separating operation for separating the engaging member of the fastening device 10 from the mating fastening device member 20. In this closed condition, if the tab 14 is picked and the engaging member of the fastening device 10 is operated in the separation direction (downward in FIG. 5), a sufficient flexibility is ensured as compared to a case in which both surfaces of the clothes are nipped by the first flat plate portion 11 and second flat plate portion 12 like the prior art, because most attaching portion is fixed to a single surface of the clothes by the first flat plate portion 11. As a result, smooth separation is possible.

Figure 7:
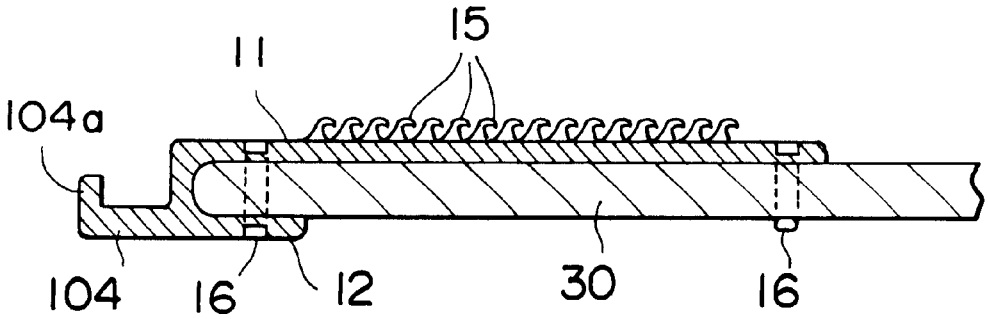
FIG. 7 is a sectional view of principal portions of the engaging member of the fastening device upon attaching, according to other embodiment of the present invention.

FIG. 7 is a sectional view showing a mounting state of the engaging member of the fastening device 100 of another embodiment of the present invention. According to the drawing, the tab 104 projected from the connecting portion 13 is projected on an extension line of the second flat plate portion 12 and a projection 104*a* is projected in a hook shape at a distal end to be directed toward the first flat plate portion 11. Instead of the projection 104*a*, it is permissible to form a cylindrical portion. When a concave portion or a cylindrical portion is formed on the tab 104, the tab 104 is easy to pick with fingers, thereby making the opening and closing operation accurate and easy.

According to the present invention, the hook directions of all the hook-shaped engaging elements 15 do not always have to be equal as the above mentioned embodiment, but for example, it is permissible to make the hook directions of hook-shaped engaging elements 15 disposed on adjacent rows opposite to each other. In this case, a necessary engaging force can be secured in any direction on the fly portion.

Further, according to the present invention, it is possible to mold a flat surface 12*a* leaving the groove portion 11*b* on the surface of the first flat plate portion 11, and bond with adhesive for example, an ordinary fiber-made surface engaging member of the fastening device of a similar shape as the first flat plate portion 11 and having hook pieces of ordinary monofilaments on the surface of woven or knitted base cloth to the flat surface of the first flat plate portion 11 with adhesive for example, without molding the hook-shaped engaging elements 15 integrally on the surface of the first flat plate portion 11.

Figure 8:
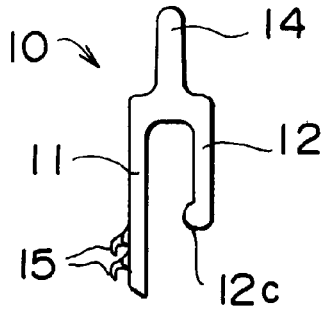
FIG. 8 is a partial side view showing a modification of the aforementioned embodiment.

FIG. 8 shows a first modification of the aforementioned embodiment. A rib 12*c* is provided on a back side of a free end portion of the second flat plate portion 12 so that it extends along an edge thereof as shown in this drawing. With such a structure, when an edge of clothes or the like is nipped between the first flat plate portion 11 and second flat plate portion 12, the aforementioned rib 12*c* holds the nipped end of the clothes by pressing, thereby preventing a displacement of the clothes or the like upon sewing.

Figure 9:
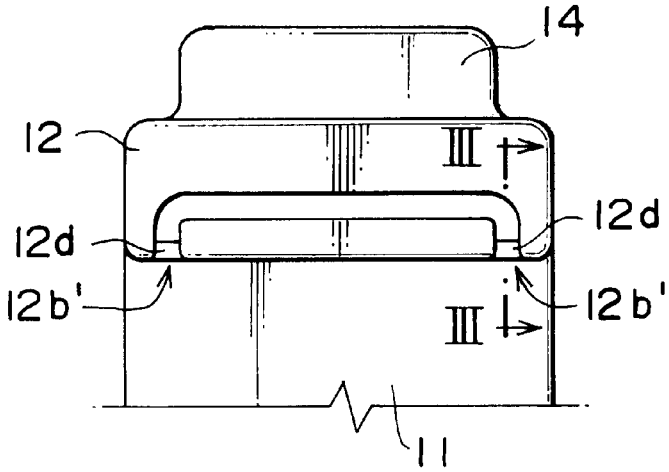
FIG. 9 is a partial front view showing another modification of the aforementioned embodiment.
Figure 10:
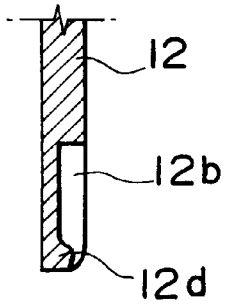
FIG. 10 is a sectional view taken along the line III—III of FIG. 9.

FIGS. 9 and 10 show still another modification of the present invention. According to this modification, an opening end 12*b*' of the groove portion 12 for forming the sewing line of the second flat plate portion 12 is formed slightly thicker so as to form a reinforcing portion 12*d*. A width thereof in the sewing direction is preferred to be equivalent to a single seam. By forming the reinforcement portion 12*d* in this manner, it prevents a fracture of the opening edge 12*b*' of the groove portion 12*b* by a sewing thread which may occur because the opening edge 12*b*' is thin.

What is claimed is:

1. An engaging member of a fastening device which is integrally molded with a substantially J-shaped section, comprising first and second flat plate portions substantially parallel to each other and made of thermoplastic synthetic resin material, each end portion connected via a connecting portion, wherein a number of engaging elements are formed on the surface of the first flat plate portion having a larger area in an upright position and a groove-like sewing line is formed along an entire peripheral edge portion thereof, a groove-like sewing line, whose end portion is open, is formed corresponding to a part of said sewing line formed on the first flat plate portion on the second flat plate portion having a smaller area, and a tab made of the same resin material is molded integrally on said connecting portion so as to project outward from the connecting portion in parallel to said flat plate portions.

2. An engaging member of a fastening device according to claim 1, wherein the plurality of said engaging elements are integrally molded on the surface of the first flat plate portion.

3. An engaging member of a fastening device according to claim 1, wherein the plurality of said engaging elements are integrally formed on a surface of a base cloth by knitting and weaving and a rear surface of said base cloth is bonded to the surface of one of said flat plate portions.

* * * * *